United States Patent [19]

Azoulay et al.

[11] 4,336,886

[45] Jun. 29, 1982

[54] DISPLAY AND DISPENSING DEVICES FOR GARMENTS

[76] Inventors: Moshe Azoulay, 1125 Texas Ave., El Paso, Tex. 79901; Albert B. Smith, 6001 LaCumbre, El Paso, Tex. 79912

[21] Appl. No.: 81,934

[22] Filed: Oct. 4, 1979

[51] Int. Cl.[3] ..... A47F 7/19

[52] U.S. Cl. ..... 211/13; 206/44.11

[58] Field of Search ..... 211/13, 990, 4, 71; 206/44.11; 229/93; 220/265, 266, 276

[56] References Cited

U.S. PATENT DOCUMENTS

| | | | |
|---|---|---|---|
| 1,962,504 | 6/1934 | Hauptli | 108/28 |
| 2,202,427 | 5/1940 | Polen | 211/4 X |
| 3,019,907 | 2/1962 | Belejack | 211/49 D |
| 3,334,952 | 8/1967 | Branch | 312/224 |
| 3,880,316 | 4/1975 | Martella | 220/276 X |
| 3,986,756 | 10/1976 | Kranich | 206/44.11 X |
| 4,030,630 | 6/1977 | Yealy | 220/276 X |

*Primary Examiner*—Roy D. Frazier
*Assistant Examiner*—Robert W. Gibson, Jr.
*Attorney, Agent, or Firm*—Fred A. Keire

[57] ABSTRACT

A device for display, storage, and selection of garments and a method for dispensing of said garments.

13 Claims, 11 Drawing Figures

DISPLAY AND DISPENSING DEVICES FOR GARMENTS

This invention pertains to a modular clothing display and a self-service unit for selection of appropriately packaged clothing, such as pants. More particularly, this invention pertains to a modular display and self-service unit adapted for selection of garments in a store in which goods are displayed in shelves or stacks and wherein the shelves or stacks, in turn, may be arranged in aisles. These modular units are especially adaptable for dispensing clothing in supermarkets, although by no means limited to that type of store.

KNOWN PRIOR ART

Applicant is aware of the following prior art: U.S. Pat. Nos. 1,458,510; 2,160,102; 2,383,389; 2,769,551; 2,773,340; 2,781,918; 2,905,330; 2,943,742; and 3,942,852.

BACKGROUND OF THE INVENTION

In the distribution and sale of goods, such as garments, e.g., pants, the goods have traditionally been sold by a salesperson from racks of clothing; consequently, packaging and/or dispensing of said goods has not been important. However, with increasing attention being devoted to self-service purchasing, the goods must be appropriately packaged and dispensed from various devices suitable for that purpose.

Because conventionally displayed clothing is not readily adaptable for self-service selection and purchase from the store owner's viewpoint, there has been an ongoing research for inventing self-service display units for dispensing garments. However, present display or dispensing devices now existing in the art for dispensing various and sundry goods are unsuitable for that purpose. Further, for displaying and dispensing pants, conventionally existing shelving and stack units as articles of manufacture have not been adaptable because these units do not allow comparison viewing, selecting, minimized misstacking, pilfering, etc. Still further, it has not been possible to adopt display and dispensing devices for one type of clothing to another type as different "self-service" requirements must be provided for each type of clothing. Moreover, package size requirements for each type of clothing must conform to available shelf dimensions. For example, common vending type of devices, i.e., vending machines, seldom, if ever, satisfy the selection needs of a populance having typical size distribution characteristics. Because a numbrr of different sizes of the same goods must be displayed and stocked for dispensing, this alone has created problems. Additionally, the mere bulk of clothing and the unwieldy display devices has often discouraged the proper selection of goods from prior art devices.

Although a number of attempts have been made to dispense various accessory clothing, such as underpants, hose, pantyhose, etc. (some with a degree of success, such as the "L'eggs" (TM) pantyhose) for the most part, present display and dispensing devices have been unsatisfactory. One reason has been that these devices have not been adaptable for dispensing more bulky clothing, such as outer pants, especially because the selection process could not be properly satisfied (without opening the packages and inspection of the packaged goods). Additionally, the requirements for display devices are such that these must meet the specifications for the shelf dimensions and/or aisle requirements found in a typical supermarket. Thus, heretofore for outer clothing, satisfactory display units have not been available which could meet the various needs of the purchasing public.

GENERAL DESCRIPTION OF THE INVENTION

A display and dispensing device has now been invented which allows storage, display, selection, and resupply of bulky articles of clothing, such as pants, in a ready manner. At the same time, these devices are especially adaptable for use, such as in supermarkets, (either in the middle of a line of shelves or at the end of an aisle of two back-to-back abutting shelves) in packages which are also tamper proof and which discourage pilfering.

The invention for the display device also resides in a simple and novel construction of parts for the display, storing, holding, and feeding of the garment packages. Further, the invention resides in an improved article for the selection of these packages as well as for minimizing any undesirable tampering, pilfering, and vandalizing of the packages, goods and/or the display device in an overall method of dispensing the goods from the display device. Hence, a method of dispensing is also claimed herein which comprises the display, anti-pilfering, resupply, etc. steps (as described herein) in a novel combination.

DETAILED DESCRIPTION OF THE INVENTION AND EMBODIMENTS THEREOF

These and other advantages and aspects of the present invention will now be described with reference to the specific embodiments as shown in the accompanying drawings in which.

Figure 2:
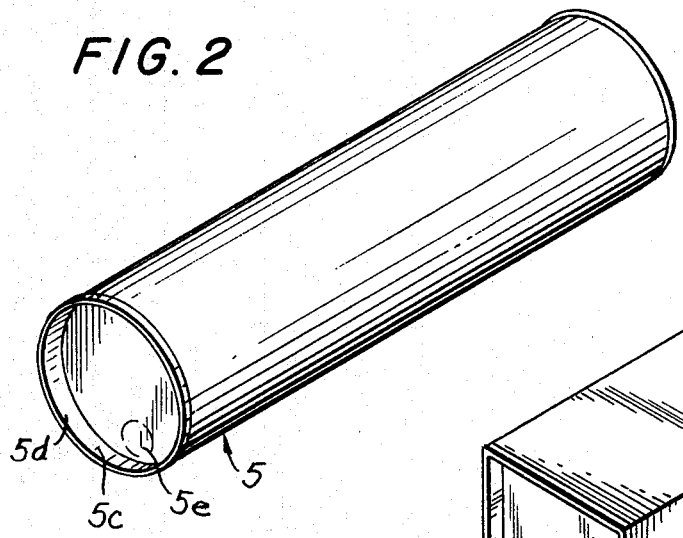
FIG. 2 is a perspective view of one form of a package suitable for use with the display devices herein.
Figure 3:
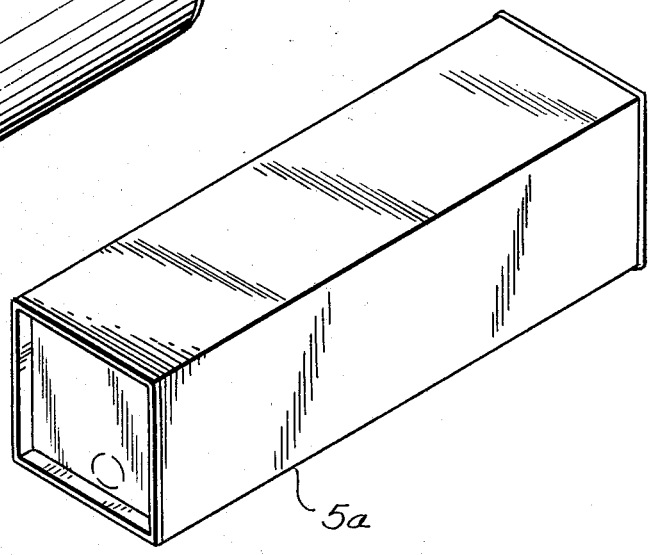
FIG. 3 is a perspective view of another form of a package device suitable for use with display devices described herein.
Figure 6:
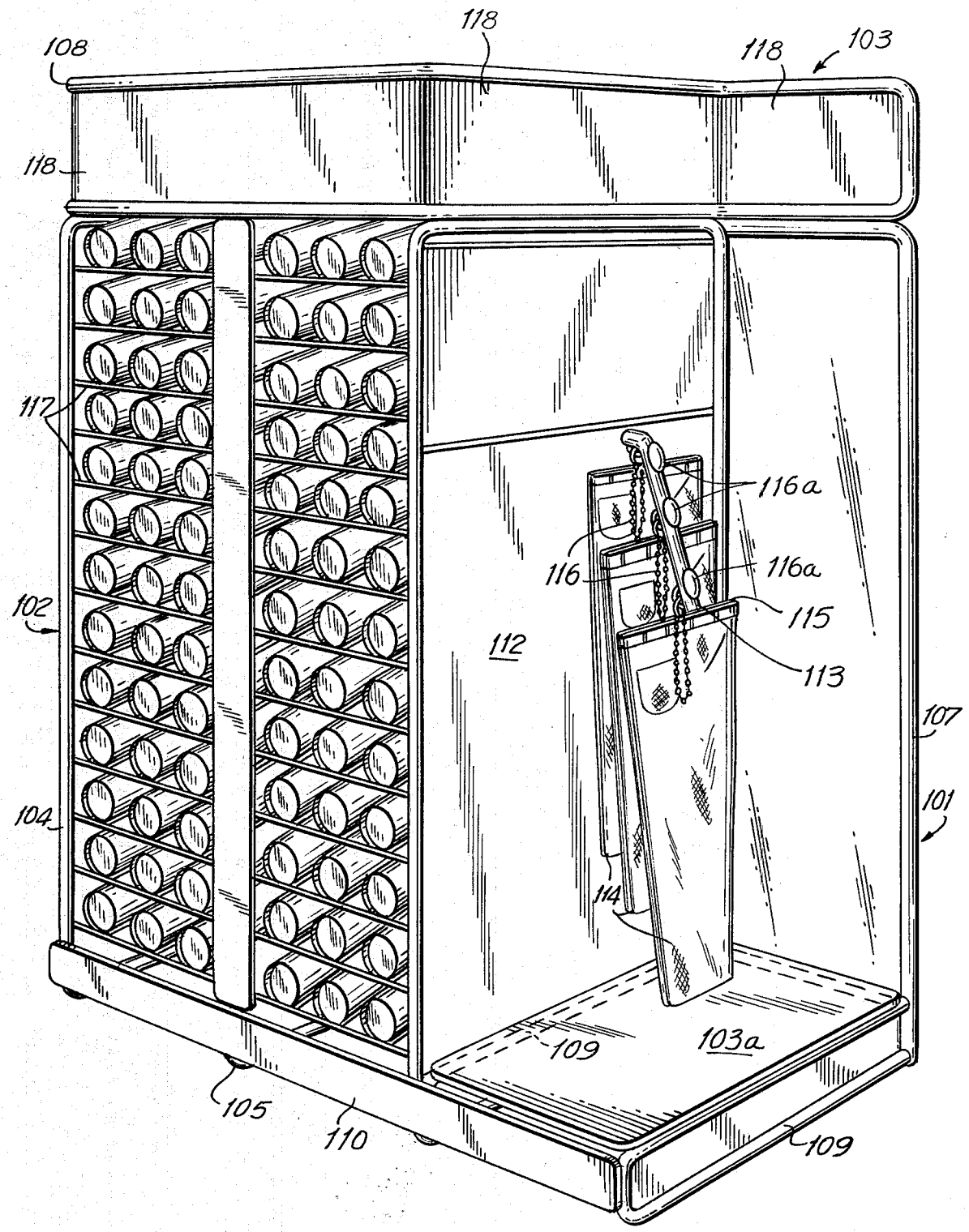
FIG. 6 is a perspective view of another embodiment for the display device, designated as modular unit B, especially suitable for placing the device at the end of two back-to-back abutting shelves.
Figure 6A:
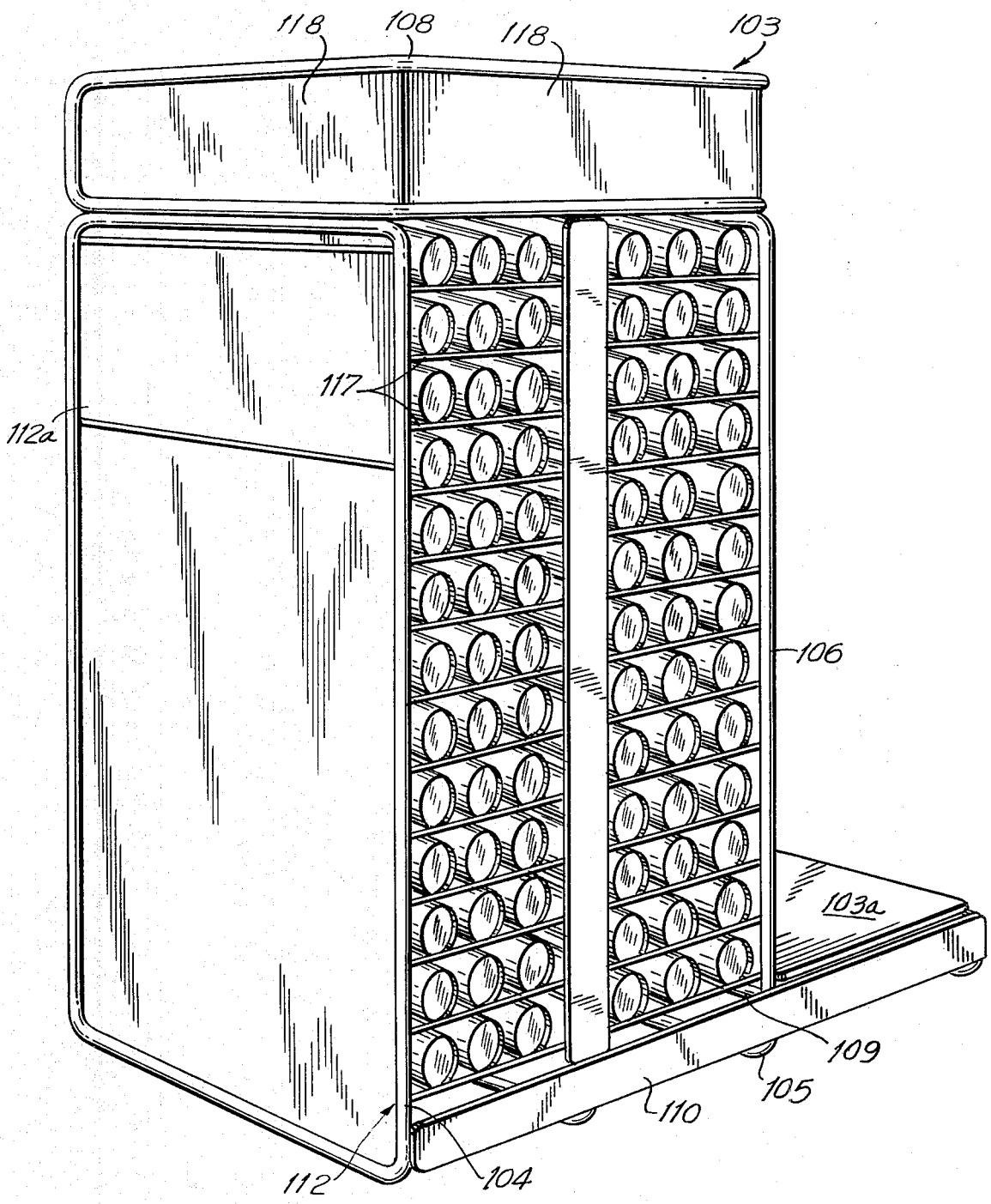
Figure 7:
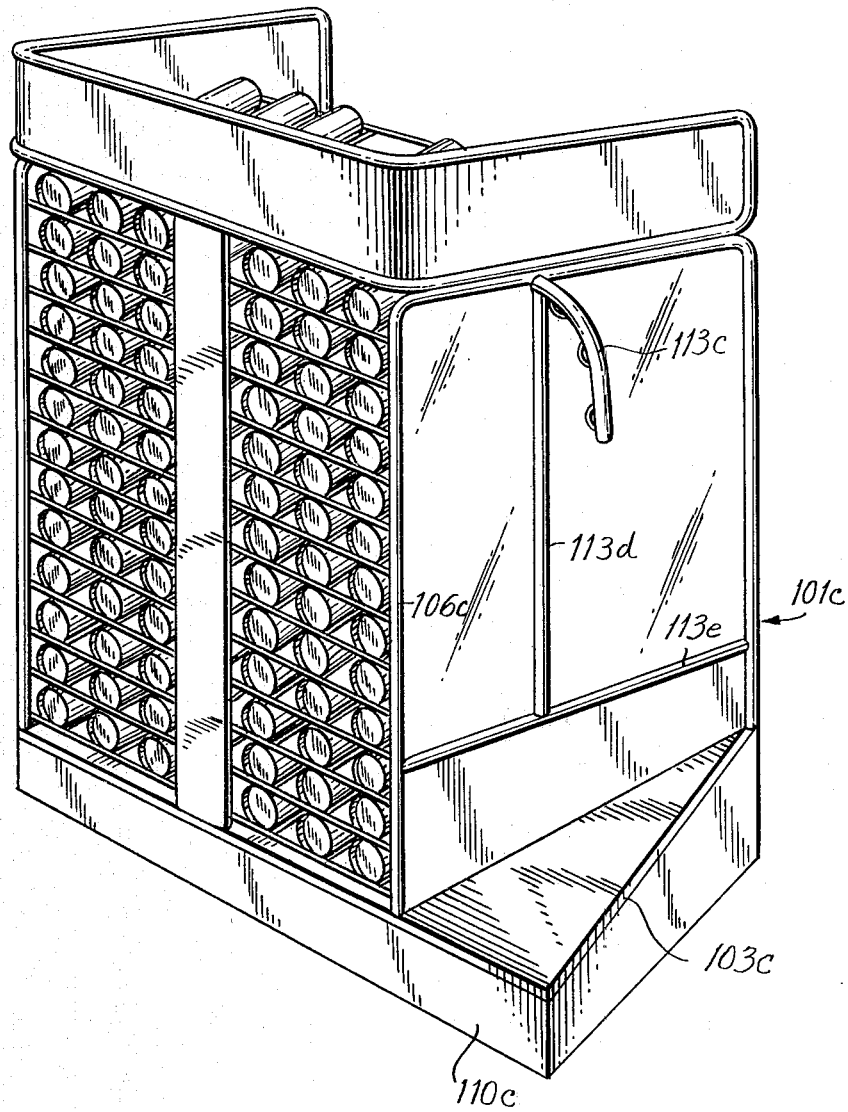
Figure 8:
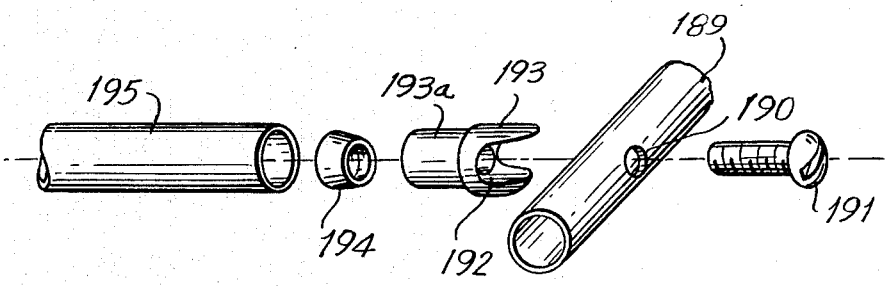
Figure 9:
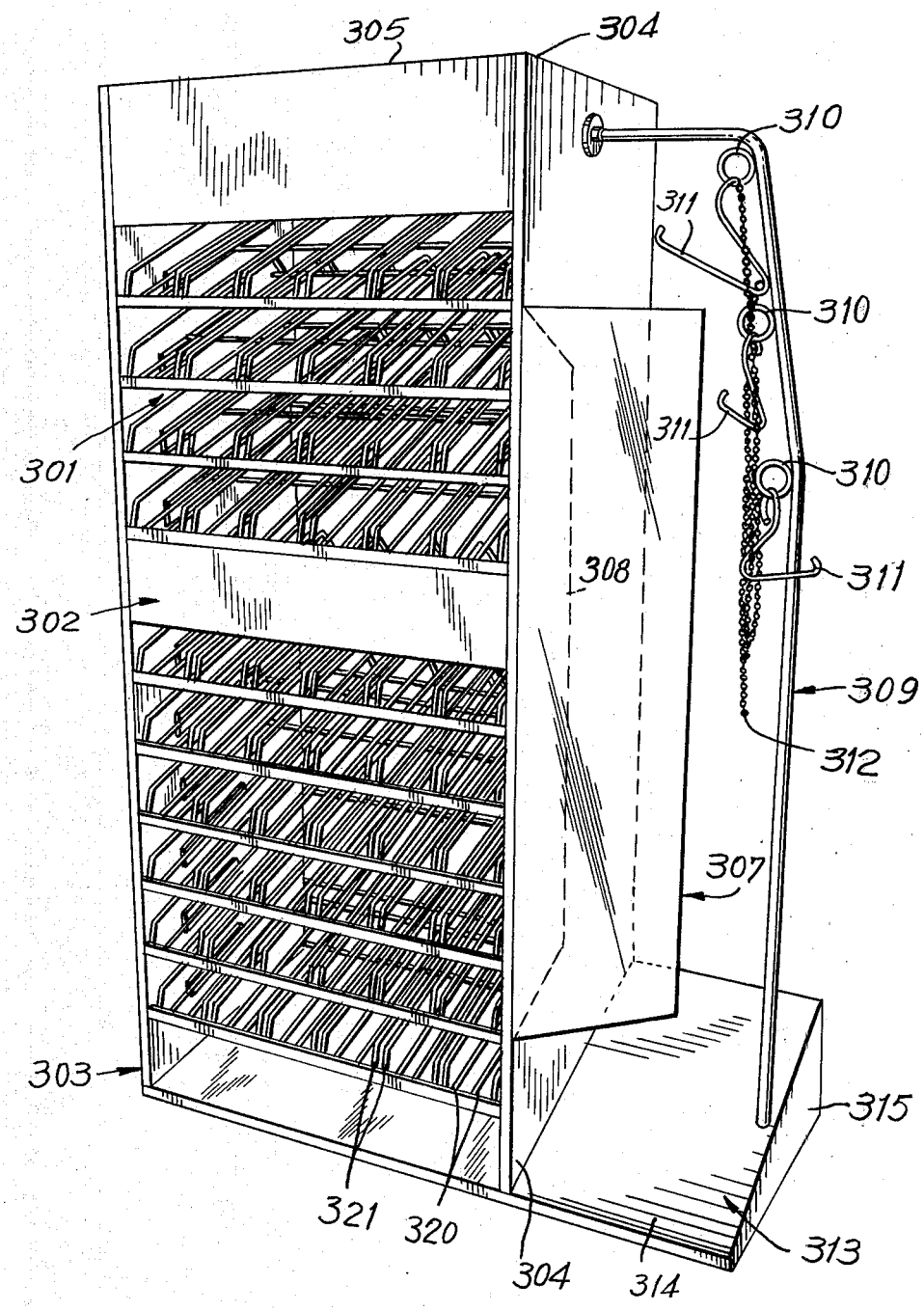

FIG. 6*a* is a perspective view looking at the left side of the device shown in FIG. 6;

FIG. 7 is a perspective view, looking at the right side, of another variation of the device shown in FIG. 6;

FIG. 8 is an exploded view illustrating how the constructional tubing elements are joined;

FIG. 9 is a perspective view of another embodiment for the display device, designated as modular unit C, capable of accommodating either of the packages shown in FIGS. 2 and 3;

and

Figure 10:
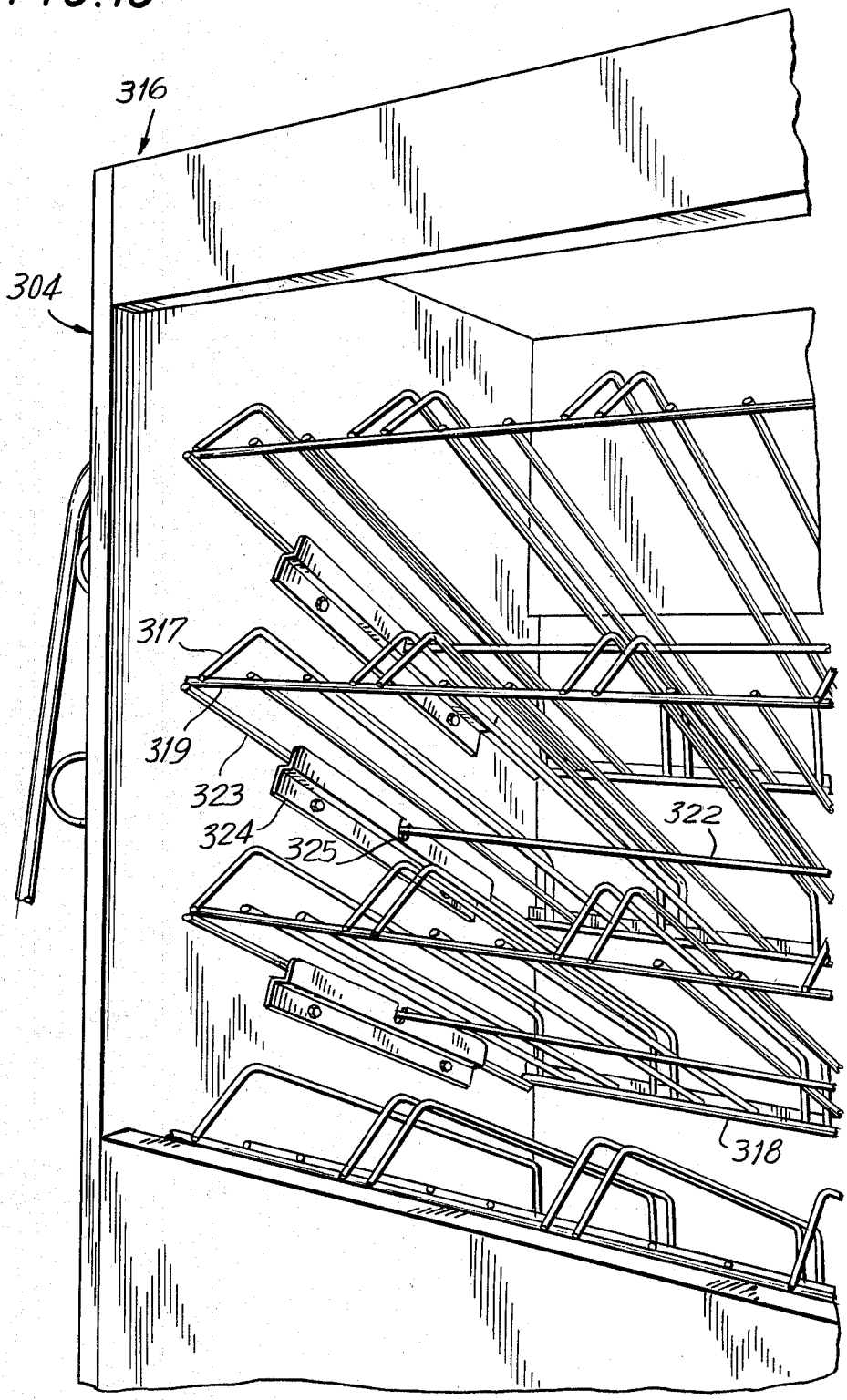

FIG. 10 is, in perspective, a rear view of a broken out section of the device shown in FIG. 9.

Referring to the component parts of the drawings by numerals, the embodiment illustrated in FIGS. 1 to 5 carries numerals in the series 1 to 100, the embodiment illustrated in FIGS. 6 to 8 carries numerals in the series 101 to 199; and the embodiment illustrated in FIGS. 9 and 10 carries numerals in the series 301 to 399.

Figure 1:
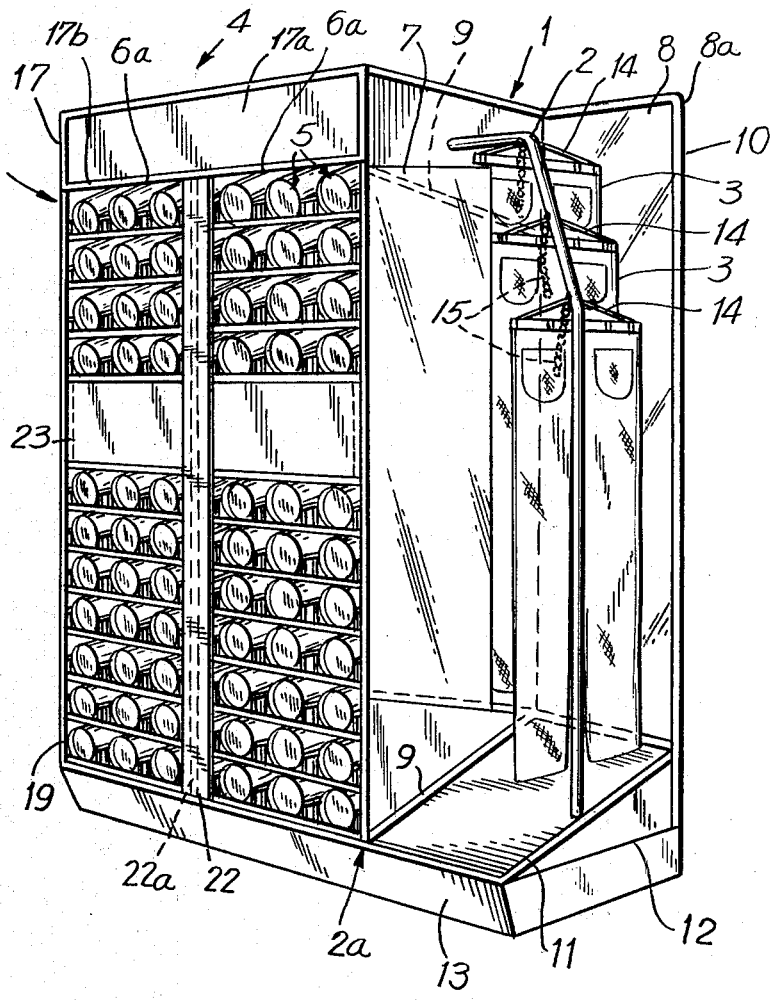
FIG. 1 is a perspective view of one embodiment for the display device especially suitable for placing the same within a line of shelves; and hereinafter described as modular unit A.

In FIG. 1, the modular unit A consists of a selection section 1 with a display bar 2, holding garments 3, of various sizes and/or styles. A storage-dispensing section 4 holds appropriately sized packages 5, color coded to illustrate the proper size and type of garment corresponding, in general, to the garments 3 displayed on bar 2.

Subsections 6 of storage section 4 may hold a line of women's and girls' garments of various sizes and/or styles or men's and boys' garments of various sizes and/or styles or any other combination of these. Although only two subsections are shown in FIG. 1, a greater number may also be provided. Likewise, only one style garment of various sizes may occupy the entire storage-dispensing section 4. In FIG. 1 for subsection 6, three vertical columns 6*a* per color code have been illustrated for each of the three color coded garments 3 displayed on the display bar 2; fewer or more rows of packages 5 may also be provided, depending on the bulk of the garment. The wide legend plate 22 extending for the height of the storage section gives additional garment size information. A narrow legend plate 2*a* may also be on either the left or right column (in FIG. 1 it is shown on the left end side).

Typically, the modular unit A shown in FIG. 1 is of an approximate size of 48" long, 22" deep (wide) and 74" high. In accordance with the invention, extra storage space may be provided by increasing the length of unit, but it has been found that a selection section 1 of a width of about 16" serves well a unit having a total length of 48".

Returning now to the selection section 1, it is bounded on two sides by mirrors 7 and 8, placed in frames 9 and 10, respectively. To allow moving of the unit without breakage of the mirrors 7 and 8, in the preferred embodiment, these mirrors are made of plastic materials of suitable thickness, such as Lexan (polycarbonated polymer available from General Electric Co.), Plexiglass, or Lucite (a polyacrylic polymer available from Rohm & Haas Co. and duPont & Co., respectively). A suitable thickness is of about $\frac{1}{8}$", but thicker plastic sheets may also be used, e.g., $\frac{1}{4}$ to $\frac{1}{2}$".

Typically, the frames 9 and 10 are made of a steel tubing of 1" in diameter, preferably plated. A hot rolled electro-welded tubing in the form of a square channel of $\frac{1}{2}$" to an edge has also been found to be useful. As plating metals, nickel, chromium, cadmium, etc. may be employed. Construction details of the framing will be described below.

Display bar 2 is shown in a permanently affixed position to panel 9 by means such as further shown herein in FIG. 8.

As illustrated in FIG. 1, display bar 2 is permanently affixed to side frame 7*a* and slanted bottom frame 11 of the selection section 1. Bottom frame 11 may also be mirrorized plastic or it may be a plain, durable material, such as a Formica or vinyl covered plywood sheet or particle board. For an in-line (i.e., middle-of-line shelf unit), for ease of viewing the garments, the frame 9 may be appropriately slanted so that the selection may be about 16" wide decreasing to about 1 or 2" from front to back; similarly, the mirror frame 10 may be pivoted and then fixedly set with the right-hand edge of frame 10 about 3–5" closer to the viewer.

On the selection bar 2, hooks are mounted for displaying garments 3, corresponding to a color coded vertical row(s) in the storage-dispensing section 4. Hence, suitably, three, but as many as six garments may be hung on the bar 2. As the display garments are not for removal from the hangers 14, these garments are permanently attached to the hangers, such as by blind or pop rivets.

In turn, the hangers 14 are permanently attached to the display bar 2 by a chain 15 (or a plastic coated wire). Chain 15 is of a length such as 36" which allows the garment 3 to be held in front of the purchaser for selection and/or viewing in the mirrors 7 and/or 8. For ease of viewing as previously mentioned, display bar 2 may, for that purpose, by pivotably swung so as to expose the maximum mirror surface.

For an end-of-aisle modular unit A, selection bar 2 may thus be swung to either side. For an in-line unit, the bar may be swung towards mirror 7.

Construction details will now be described for the modular unit A shown in FIG. 1. All of the framing, as mentioned previously, is of a $\frac{1}{2}$" steel tubing. Conveniently, a 1" tubing of a wall thickness of about 0.05 inches may be used. For the square channel previously mentioned, the same wall thickness may be used. As shown, frame 9 has the $\frac{1}{2}\times\frac{1}{2}$"$\times$0.05 (wall thickness) channel around the periphery thereof. In the corner 16 where the frame 9 meets frame 10, no tubing appears for frame 9 as the frame abuts the frame 10 holding mirror. The entire width of the unit A is defined by back frame 10. This frame may have a cross bracing (not shown) in the form of an X or only one cross member.

On the top of the modular unit, a crown frame 17, shown in FIG. 1, follows the shape of the display unit such as for one with a rectangular or angled mirror section. Frame 17 may, again, be a round or square tubing with plastic inserts 17*a* called "header cards" between the frame. Header cards 17*a* have printed thereon the description of the goods and color code. The header cards fit into a channel 17*b* attached to frame 17.

For stiffening the modular unit A, an intermediate vertical stiffening frame 22*a* may be used in combination with the wide legend plate. Similarly, one or a plurality of horizontal stiffening frames 23 may be used at a position intermediate the top and bottom of frame 19.

As a base for the modular unit A, a side kick frame 12 is used; to it is joined the front kick frame 13. For ample toe room, the front kick frame 13 is slanted forwardly from the bottom thereof, i.e., the floor on which the modular unit A rests; frame 13 may also be vertical. In either case, frames 12 and 13 on each side (there may be an optional back frame, not shown) may be protected with a sheet metal corner guard 13*a* (not shown) from damage by food carts. Within each of the frames 12 and 13, a suitable material may be mounted (as further described herein), such as a plastic sheet of suitable thickness, e.g., $\frac{1}{4}$" Plexiglass, Lexan, ABS sheet, $\frac{1}{2}$" plywood covered with Formica, plywood covered with vinyl, or like material (frames 12 and 13 may also be solid boards covered with these same materials).

A plastic sheet, such as between the horizontal stiffening frame 23 or the top frame 17, and the left side frame (not shown in FIG. 1) may carry appropriate instructions, illustrations, or advertising material.

The entire left side of modular unit A may be one frame shown in FIG. 6*a* as 104 (not shown in FIG. 1).

Frame 104 has a mirrorized plastic 112 (in one sheet or a number of plastic inserts 112*a*) and the material may carry instructions, display advertising, etc.

Figure 4:
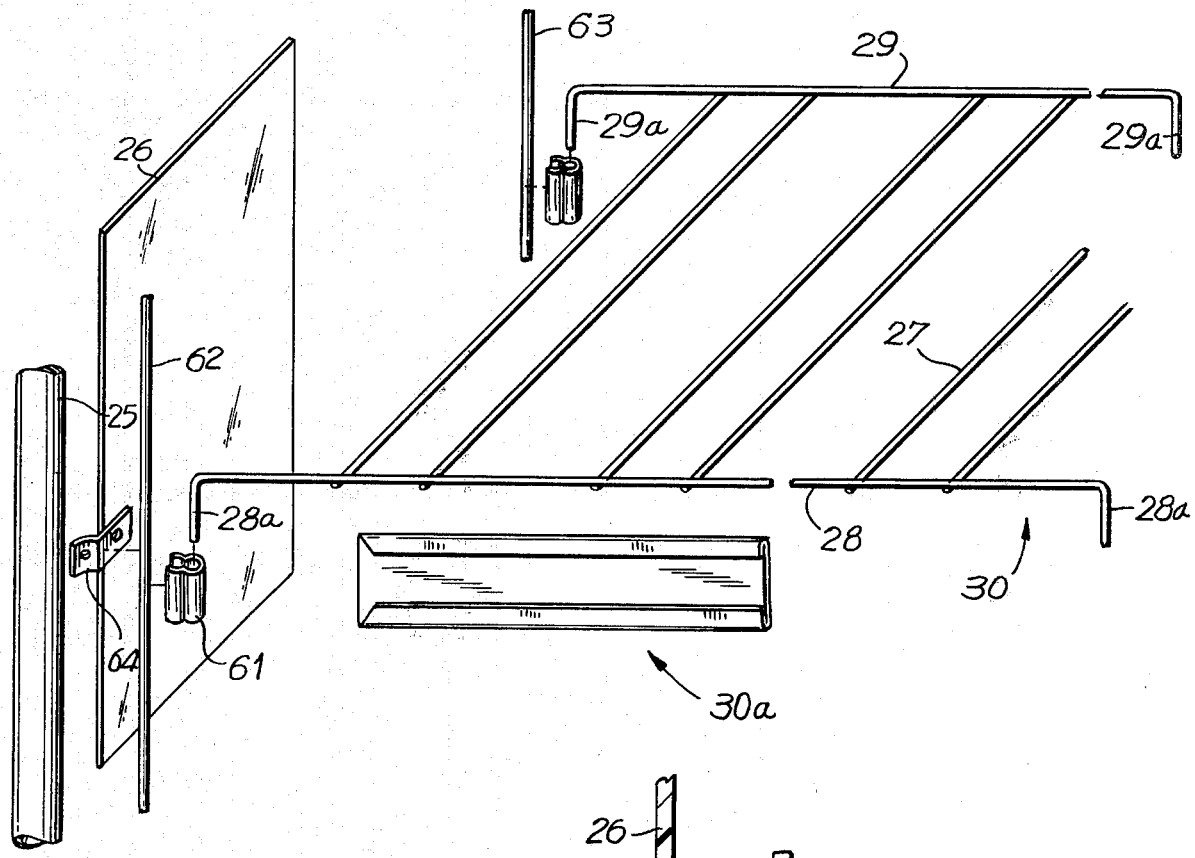
FIG. 4 is a partial exploded view of construction elements for the device shown in FIG. 1.
Figure 5:
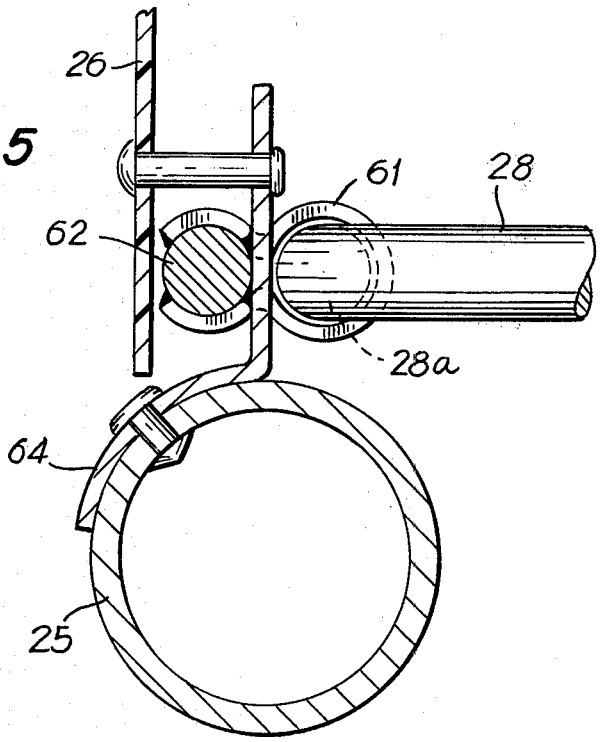
FIG. 5 is a top view of construction elements shown in an exploded view in FIG. 4.

With reference to the foregoing and to FIG. 4, it shows in a partial, exploded view, construction elements in an assembly view for joining any of the plastic sheets to a frame. In FIGS. 4 and 5, the frame is designated 25. The assembly of trays are designated as 30 and will also be explained in the same connection. Thus, in FIG. 4, each shelf 30 is defined by rod members 27 appropriately spaced apart to cradle between the rods 27, the cylindrical package 5 shown in FIG. 2. Rods 27 may be positioned so that the cradling of each package 5 falls in a vertical row. Rods 27 are joined to a front rod holder 28 at the front of the modular unit A and a rear rod holder 39 at the rear of modular unit A. These rod holders 28 and 29 together with the entire array of rods 27 define an individual tray 30. A price channel molding 30*a* may be mounted on the front rod holder 28 as shown in FIG. 4.

A total of 14 trays are illustrated for the storage section 4; the trays 30 are attached to the frame 25 and are elevated at the rear, vis-a-vis, the front by clips 61 for the front of each of the trays 30 so that with respect to the horizontal plane, the rear rod holder 29 is elevated at about 20 to 30 degrees. Clip rods 62 and 63 form a pair of clip rods for the left side of the trays and a corresponding pair is found on the right-hand side for each of the trays. The clip rods 62 and 63 are attached to the frame e.g., frame 25, by frame clips 64 which are welded to the clip rods 62 and 63 and the frame clips 62 are mounted on the frame tubing either by welding or by riveting as shown in FIGS. 4 and 5 in the last, in top view thereof. As the frame clips 64 are permanently attached to clip rod 62, these may be fewer in number than the trays 30. Before the clip rods 62 are mounted on frame 25, and clips 61 are welded to the clip rod 62 or permanently attached thereto such as by pressure fit, the legs 28*a* and 29*a* of tray rods 28 and 29, respectively, are inserted in the cylindrical, hollow clips 61 which hold the trays 30 securely in place as well as provide additional rigidity. An extension of the frame clip 64 is provided for securing a mirrorized plastic or any sheet 26*a* shown in FIG. 4 or a mirrorized plastic sheet such as 112 shown in FIG. 6.

In the event the package 5 is of the type as shown in FIG. 3, as package 5*a*, then as a tray, one shown for embodiment C (further described herein) may be used.

With reference to FIG. 6, it illustrates another embodiment of the display device designated as modular unit B for placement at the end of two back-to-back abutting shelves such as found in supermarkets. Although modular unit B has been shown for use at the end of an aisle, it is also suitable for adoption and use within a row of shelves provided the dimensions of same are adopted for that purpose.

Modular unit B, as shown in FIG. 6, consists of a selection section 101, and a storage section 102. A crown section 103 at the top thereof adds rigidity. A floor member 103*a* defines the lower part of the selection section 101.

Modular unit B is constructed of plated steel tubing of $\frac{7}{8}''$ dia.×0.045″ wall thickness for the major frames which will be described herein, with the plating type and wall thickness as previously specified.

Three major frames define the modular unit, the left frame 104, the right frame 106, and the back frame 107.

The crown section 103 is defined by a dipper shaped frame 108 with a dipper opening towards the back or rear of the unit. All of the frames are joined by pop or blind rivets.

The floor 103*a* is supported by a U-shaped double strand frame 109. One leg of the U is shown in FIG. 6 at the lowermost right-hand part, and the other leg (and the bottom of the U) by dashed lines.

Front kick plate 110 is affixed to the frames 104, 106, and 109, and to a center pole 105. For rigidity, the center pole 106 may be a double pole or an entire frame such as 106.

In the selection section 101, partially within back frame 107, is affixed a mirrorized plastic 111 material of the type previously described and in the manner as shown in FIGS. 4 and 5. Similarly, within the right-hand frame 106, partially or entirely, a mirrorized plastic sheet 112 may be similarly affixed. Besides allowing the inspection of a selected garment, the sheet 112 may be carrying price information, advertising, or instructions for selection, it adds rigidity as well.

The floor 103*a* may be of a $\frac{1}{2}''$ to $\frac{3}{4}''$ vinyl-plywood or Formica-plywood laminate. The same material may be used for the kick plate 110.

On selection bar 113 are hung garments 114; these garments are permanently affixed to hangers 115, such as by pop rivets. Chains 116 permanently hold the hangers 115 to the selection bar 113. Appropriate letters for identifying size or style may be attached to the hangers 115. Selection bar 113 carries thereon color code information 116*a* which identifies the garments in the storage section 102. Selection bar 113 extends from left to right and is affixed to a cross-member 113*a* (not shown) of frame 106 such as by welding.

A plurality of storage trays 117 are placed within the storage section 102. These storage trays 117 are constructed (as previously described) to accept garment packages 5 and 5*a* shown in FIGS. 2 and 3, respectively. Generally, packages are stored two or three deep in a storage tray 117.

Crown section 103 carries any attention attracting information such as advertising, trademarks, etc. on the plastic sheets 118 made such as of a 0.040 ABS plastic (acrylonitrile-butadiene-styrene) removingly insertable in the crown frame 108 from the corners thereof in suitable channels (not shown).

The left-hand frame 102 carries within it a plastic sheet 112 or 112*a* again describing the garment sold therein or any other necessary information. The sheet 112 may be in a number of sections such as 112*a* and each section may also be mirrorized.

With respect to the device shown in FIG. 7, it illustrates, as a different feature from that shown in FIG. 6, a canted selection section 101*c*. Instead of being square and flat, as section 101 is in FIG. 6, the section 101*c* is angled from a front kick frame 110*c* of a height of about 4″ to a height of about 12″ at the rear, while the base of the triangular floor 103*c* goes from about 16 to 22″ (depending on construction) to about a point. The reason for this device is that it prevents placing unwanted goods or packages on the slanted floor 103*c*.

In other respects, the selection bar 113*c* may be the same as previously described or selection bar 113*c* may have an extension 113*d* which may be permanently affixed to the frame 106*c* and to cross brace 113*e* therefor.

In FIG. 8, the conventional manner of joining tubing end to end has been illustrated. Accordingly, a tubing 189 has a pair of holes 190 of a size suitable to accept a bolt 191, which projects through the holes 190, and is received by an unthreaded hole 192 in a jaw fitting 193, adopted to fit partially around tubing 189. In turn, the jaw fitting 193 has a necked down section 193*a* which fittingly engages the inside diameter of another tubing sized to receive the same. As the bolt 191 protrudes beyond the neck 193, it is capable of engaging a bevel plug generally of a stiff, but resilient material having a thread back plate (not shown). When the bolt 191 is preassembled with the jaw fitting 192 and engages the bevel plug 194 through hole 194, the whole assembly may be inserted into tube 195 and be tightened securely by the expansion of the bevel plug 194 upon turning of the screw 191.

With reference to FIG. 9, it shows in a perspective view another embodiment for the display device designated as modular unit C, conveniently adopted for "in-line" shelf display and selection of suitable garments. For modular unit C, the elements thereof are labeled with the numbers in series 301 to 399. Thus, in FIG. 9, as shown, the display section 301 is not vertically subdivided. However, a horizontal stiffening or brace member 302 is provided between each side panel 303 and 304. A stiffening or brace member 305 is shown for the top of the device C; a display board 306 (not shown) may be mounted thereover. A mirror 307, such as previously described, is affixed to a triangular frame 308 as shown in FIG. 9 by dashed lines. The frame 308 may be of a solid board, e.g., plywood or a plastic material. To the side panel 304 is permanently affixed display rod 309, having attachment devices, e.g., rings 310 permanently welded thereto in which are hung hangers 311. To the ring 310 is permanently attached a chain 312 which, in turn, is joined to the hanger 311; each hanger has its own chain and ring; a greater number than shown in FIG. 9 may be used. At the bottom of the selection unit 313 is a slanted platform 314 (to avoid placing packages on the same). A side frame therefor 315 is shown in FIG. 9. The whole device C may be mounted on a suitable platform (not shown, but of a type previously described in connection with units A and B).

Side panels 303 and 304 may be appropriately faced with a plastic material, such as Formica, including edges thereof.

With respect to FIG. 10, it shows, in a perspective view, a broken out section of the device shown in FIG. 9, the right-hand side panel 304 in FIG. 9 being the left hand panel in FIG. 10. A top brace 315 and a bottom brace 317 (not shown) provides, in combination with the other bracing previously described, the necessary rigidity.

Construction of the display trays 317 is as follows: each tray has a front rod 318 and a rear rod 319 and for each package, e.g., 5 or 5*a*, a pair of support rods 320, and a pair of spacer rods 321. At the left or right edge of the tray 317, only one spacer rod is needed. On the front rod is mounted a display molding (described in FIG. 4); the display molding may act as a package sliding restraint.

Each tray has a bottom center rod 322, shown in FIG. 10. Each tray 317 has a left and right-hand bottom side rod 323, which seats on each side of the device in a bracket 324 mounted at an appropriate angle onto side panels 303 and 304 with the center rod 322 fitting into a restraint notch 325. This arrangement allows facile mounting of trays 317, replacement of same with differently spaced subsections thereof, and adoption for interchangeable and different display packages, such as shown in FIGS. 2 and 3. In FIG. 9, a total of 11 shelves are shown. All of the previously described trays are front loaded with the packages such as shown in FIGS. 2 and 3.

With respect to the package shown in FIG. 2, it is numbered as 5, and that shown in FIG. 3, as 5*a*. For the package in FIG. 2, a semipermanent closure 5*c* in the form of a plastic dish, fitting very snuggly, engages the interior wall 5*d* of the package 5. The plastic closure 5*c* has a punch-out finger hole insert 5*e* used for removing the closure 5*c* from the interior wall 5*d*.

If the punch-out finger hole insert 5*e* has been removed, then the package can be inspected at a check-out counter if the contents thereof are exchanged or are missing. If the closure 5*c* has been removed, it may be reinserted or replaced with a new one at a check-out counter or upon servicing the devices A, B, or C. Generally, a tightly adhering price label may also be placed over punch-out hole 5*e* so that tampering of the goods is minimized thereby.

With respect to the package shown in FIG. 3, it is in a form of a box, which, again, may be end loaded through similar tamper-proof closures as shown for the FIG. 2 package. This box similarly fits into appropriately sized trays previously described.

As described above, the modular units illustrate the improvements offered to the purchasing public for selection of garments from a unit containing garments in a stored section. The compactness of the unit allows these to be placed in a store and passes along to the public the benefits based on the self-service concept. Moreover, the unit helps the store owner to store, dispense, and replenish his goods and minimizes pilferage of the garments when sold in the packages as described herein.

From the above description, the invention will, it is believed, be clearly understood, including any changes in size and shape of the component parts. Moreover, manifestly the form of the invention disclosed herein is susceptible of modifications without departing from the inventive concept, and the rights are reserved to all such modifications falling within the claims defining the invention.

What is claimed is:

1. A device for display and storage of garments comprising a storage section and a selection section, said storage section including a vertically disposed right-hand frame, a vertically disposed left-hand frame, a crown frame fixedly attached to an upper terminal portion of said vertical left and right-hand frames, said crown frame consisting of a plurality of sections approximately horizontally disposed to said vertical left and right-hand frames, a vertical back frame fixedly attached to said vertical left and right-hand frames, a sheet for said left and right-hand frame, a partial sheet for said back frame and a right most portion of said back frame and a right most portion of said right-hand frame, a floor member defined by the right most portion of said back frame and said right-hand frame, disposed abuttingly to said back and right-hand frame, disposed abuttingly to said back and right-hand frames and forwardly of said back frame; support members for said floor member, a mirror for said back frame sheet, a plurality of storage trays disposed between the terminal portions of said right-hand and left-hand frames adopted to receive a plurality of packages, a bar fixedly attached to a frame above said floor member, a plurality of garments for inspection of same permanently incorporating hangers within each of said garments and an extendable attachment for each of said hangers from said bar to said hanger for removal of same for a predetermined distance.

2. The device as defined in claim 1, wherein to said floor member is fixedly attached a kick plate for a right-hand portion thereof and a kick plate for a front portion thereof, said kick plate for said front portion thereof extending leftwardly to said left frame.

3. The device as defined in claim 2, wherein said floor member is parallel to said bottom terminal portion of said left, right, and back frames.

4. The device as defined in claim 2, wherein said floor member is inclined downwardly from said back frame to said front of said unit.

5. The device as defined in claim 1, wherein the vertical right frame is abutting the back frame perpendicularly.

6. The device as defined in claim 1, wherein the right frame is abutting said back frame at an angle different from perpendicular.

7. The device as defined in claim 1, wherein said sheet for said back frame is at an angle perpendicular to said right-hand frame.

8. The device as defined in claim 1, wherein said sheet for said back frame is at an angle different from perpendicular and said back frame follows said angle for said sheet.

9. The device as defined in claim 1, wherein said selection bar is pivotably affixed to said right-hand frame between said floor member and upper terminal portion of said right-hand frame.

10. The device as defined in claim 1, wherein said selection bar is rigidly affixed to said right-hand frame proximate to an upper terminal portion thereof.

11. The device as defined in claim 1, wherein said right-hand frame includes a triangular section with a mirror surface.

12. The device as defined in claim 1, wherein said sheets within said frames are mirrors.

13. The device as defined in claim 1, wherein a plurality of trays, each including a plurality of package holding means are vertically arrayed over each other between the left and right-hand frames thereof.

* * * * *